US009533210B2

(12) United States Patent
Lee

(10) Patent No.: US 9,533,210 B2
(45) Date of Patent: Jan. 3, 2017

(54) CONVERTIBLE GAME SYSTEM

(71) Applicant: Richard Lee, Rockville, MD (US)

(72) Inventor: Richard Lee, Rockville, MD (US)

(73) Assignee: Sport Squad, Inc., Rockville, MD (US)

( * ) Notice: Subject to any disclaimer, the term of this patent is extended or adjusted under 35 U.S.C. 154(b) by 0 days.

(21) Appl. No.: 14/550,296

(22) Filed: Nov. 21, 2014

(65) Prior Publication Data

US 2016/0144256 A1 May 26, 2016

(51) Int. Cl.

| | |
|---|---|
| ***A63B 63/08*** | (2006.01) |
| ***A63B 69/00*** | (2006.01) |
| ***A63B 24/00*** | (2006.01) |
| ***A63B 63/00*** | (2006.01) |

(52) U.S. Cl.

CPC ..... *A63B 69/0071* (2013.01); *A63B 24/0021* (2013.01); *A63B 63/008* (2013.01); *A63B 63/083* (2013.01); *A63B 69/0002* (2013.01); *A63B 2063/001* (2013.01); *A63B 2063/002* (2013.01); *A63B 2208/0204* (2013.01); *A63B 2210/50* (2013.01); *A63B 2243/007* (2013.01)

(58) Field of Classification Search

CPC . A63B 69/0071; A63B 24/0021; A63B 63/00; A63B 71/0669; A63B 69/0002; A63B 71/0619; A63B 63/004; A63B 69/002; A63B 63/06; A63B 63/083; A63B 57/40; A63B 57/357

USPC ..... 473/433, 416, 422, 56, 479, 447, 454, 473/451; 273/371.3, 398, 402

See application file for complete search history.

(56) References Cited

U.S. PATENT DOCUMENTS

| | | | | | |
|---|---|---|---|---|---|
| 4,762,319 | A * | 8/1988 | Krumholz | A63B 63/08 | 473/416 |
| 4,786,053 | A * | 11/1988 | Barnes, Jr. | A63B 71/023 | 473/416 |
| 5,431,411 | A * | 7/1995 | Padilla | A63B 63/004 | 473/435 |
| 5,443,259 | A * | 8/1995 | Segan | A63B 63/083 | 273/401 |
| 5,513,843 | A * | 5/1996 | Russell | A63B 63/004 | 473/416 |
| 5,584,480 | A * | 12/1996 | Grimsrud | A63B 71/023 | 473/447 |
| 5,613,676 | A * | 3/1997 | Connolly | A63B 63/004 | 473/416 |

(Continued)

OTHER PUBLICATIONS

Deluxe 7 in 1 Rotating Game Table, http://www.rakuten.com/prod/deluxe-7-in-1-rotating-game-table-in-black-and-silver/212994255.html, printed Sep. 26, 2014 or earlier.

(Continued)

*Primary Examiner* — Mitra Aryanpour

(74) *Attorney, Agent, or Firm* — Muskin & Farmer LLC

(57) ABSTRACT

A convertible game system configured to be used by a player at home who wishes to practice skills from multiple sports on an apparatus that does not require extensive space requirements. The game system has a frame, with a hopper section and a mounting section, a ball return, and a rotational component. The rotational component is mounted to the frame at the mounting section by a locking bearing system. For use, a player unlocks the locking bearing system, rotates the rotational component to display the desired game face, then re-locks the locking bearing system before beginning game play. The rotational component can have as few as 3 faces, and as many as 8 faces.

20 Claims, 11 Drawing Sheets

FIG. 1B

(56) References Cited

U.S. PATENT DOCUMENTS 6,149,152 A * 11/2000 Mancke ..... A63B 63/004 434/251
6,338,686 B1 1/2002 King
6,347,797 B1 2/2002 Tsai
6,929,569 B1 * 8/2005 Wang ..... A63B 24/0021 473/433
7,247,105 B2 * 7/2007 Huntsberger ..... A63B 24/0021 473/433
7,351,168 B1 * 4/2008 Pannell ..... A63B 63/004 473/476
7,523,942 B2 * 4/2009 Chung ..... A63B 24/0021 473/433
7,794,339 B2 * 9/2010 Bailey ..... A63B 69/0002 473/422
8,033,923 B2 10/2011 Chung
8,398,499 B2 3/2013 Voden
8,413,990 B2 4/2013 Allshouse
8,894,513 B2 * 11/2014 Arroyo ..... A63B 63/00 473/422
8,900,074 B1 * 12/2014 Johnson ..... A63B 69/205 473/422
2002/0068650 A1 * 6/2002 Wang ..... A63B 63/083 473/479
2003/0030218 A1 * 2/2003 Zucchi ..... A63B 63/00 273/371
2003/0153413 A1 * 8/2003 Wood ..... A63B 63/083 473/479
2004/0058756 A1 * 3/2004 Huang ..... A63B 69/0071 473/433
2006/0040770 A1 * 2/2006 Chou ..... A63B 69/0071 473/433
2008/0042358 A1 * 2/2008 Chen ..... A63B 69/0071 273/371
2008/0312011 A1 * 12/2008 Edmondson ..... A63B 69/0002 473/456
2011/0074106 A1 3/2011 Allhouse

OTHER PUBLICATIONS

International Search Report in counterpart PCT application (PCT/US2015/059624).

* cited by examiner

FIG. 4
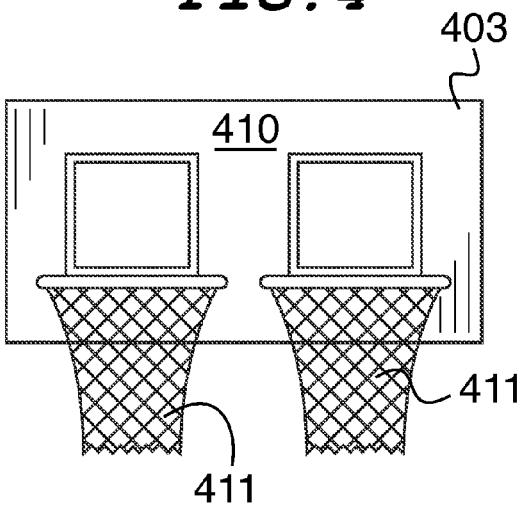
FIG. 5
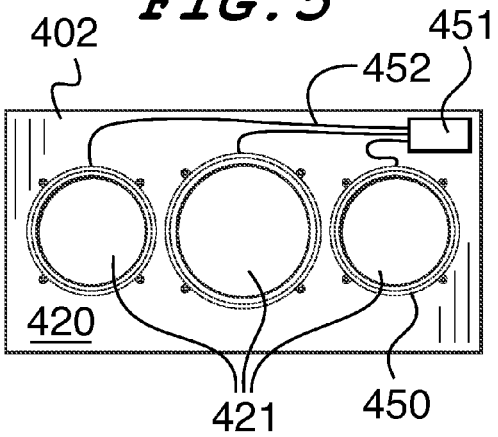
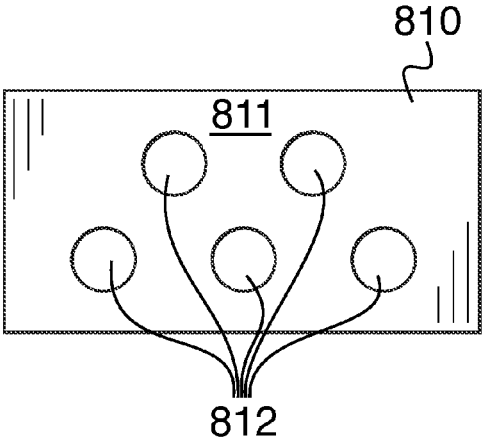
FIG. 6
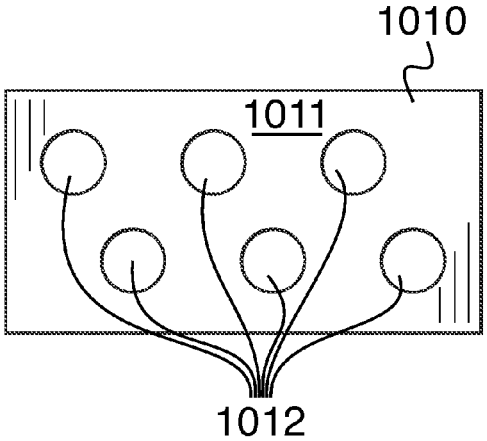
FIG. 7

FIG. 9
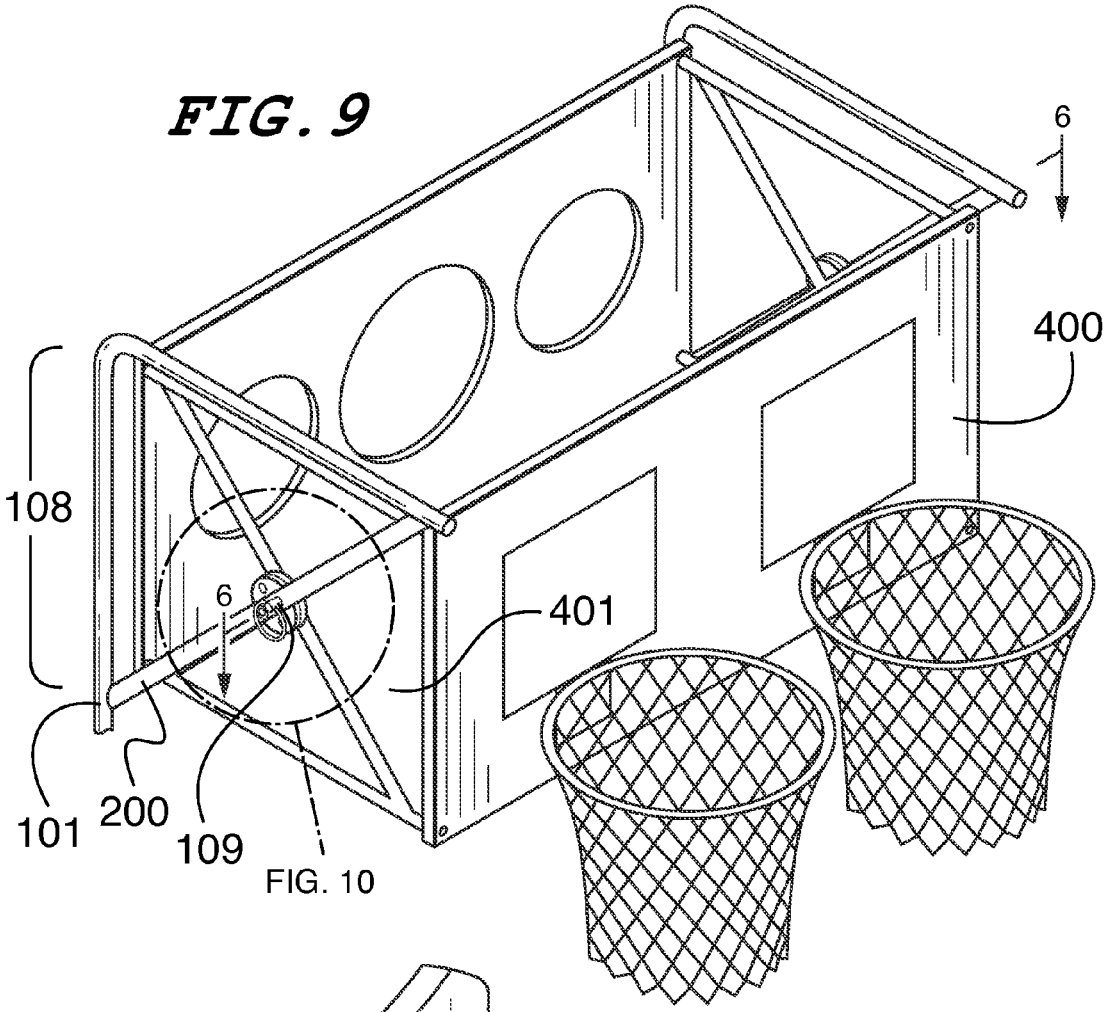
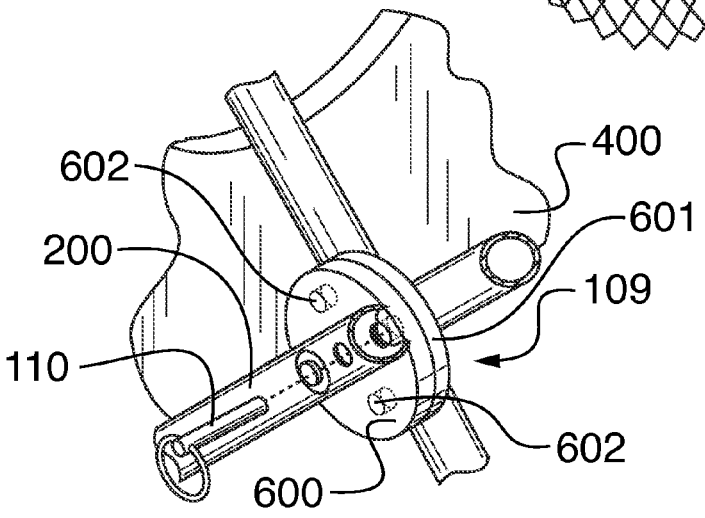
FIG. 10

FIG. 12
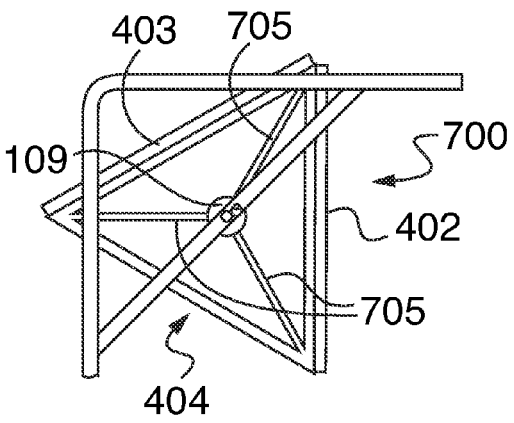
FIG. 13
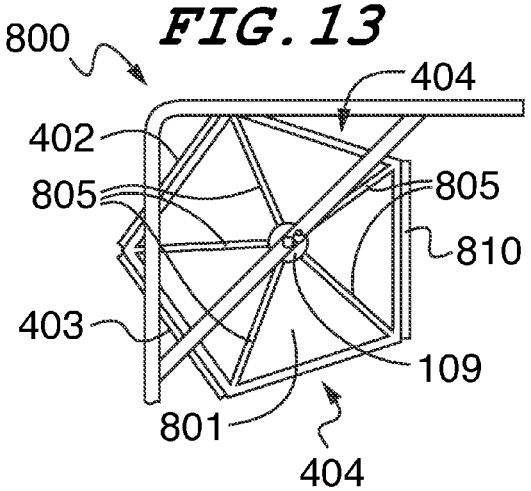
FIG. 14
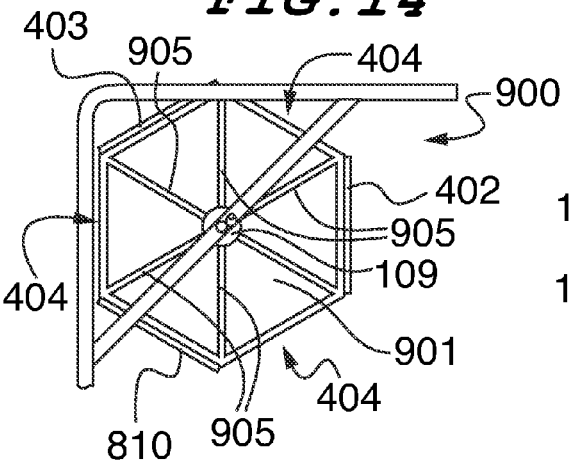
FIG. 15
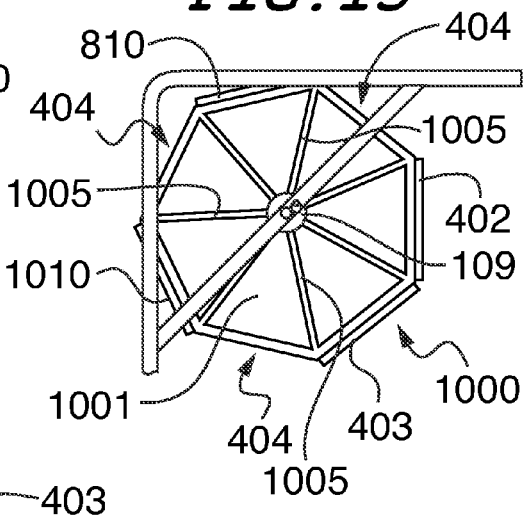
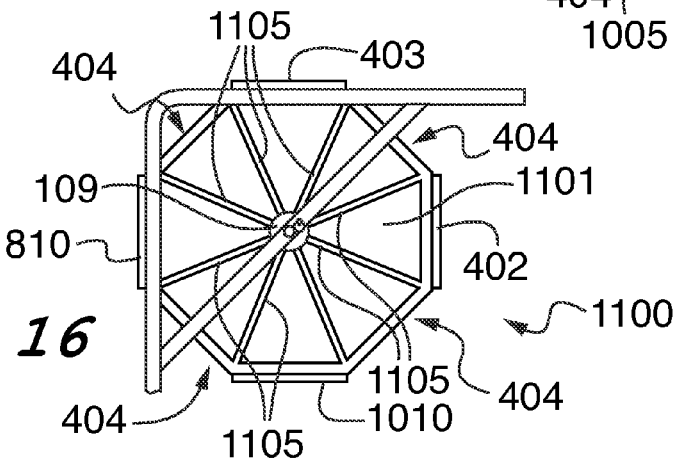
FIG. 16

CONVERTIBLE GAME SYSTEM

FIELD OF THE INVENTION

The present invention deals with an apparatus for amateur athletes who have limited space at home, but wish to practice multiple sports.

BACKGROUND

People enjoy playing sports, but most amateur athletes lack the personal resources to construct full game playing fields, especially for different games, such as basketball or football. Constructing an entire football field or basketball court is simply impractical, and thus the market has arisen for personal sport systems. However, personal sport systems, such as a portable basketball hoop or football toss system, can be large and take up a significant amount of space, meaning an athlete may have to choose only one sport to practice at home, even though they wish to practice skills from other sports.

What is needed is a convertible game system that allows a user to practice skills for multiple sports using the same equipment, which can be easily converted between sports while only using the required space for a single personal sports system.

SUMMARY OF THE INVENTION

It is an aspect of the present device to provide a convertible game system that can allow a user to practice skills for multiple sports using the same equipment, which can be easily converted between sports while only using the required space for a single personal sports system.

These together with other aspects and advantages which will be subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

Further features and advantages of the present device, as well as the structure and operation of various embodiments of the present device, will become apparent and more readily appreciated from the following description of the preferred embodiments, taken in conjunction with the accompanying drawings of which:

FIG. 4 is a front view of a basketball face, according to an embodiment.

FIG. 5 is a back view of a football face, according to an embodiment.

FIG. 6 is a front view of a softball face, according to an embodiment.

FIG. 7 is a front view of a baseball face, according to an embodiment.

FIG. 9 is a perspective view of a rectangular rotational component, according to an alternate embodiment.

FIG. 10 is a close up view of a locking bearing system, according to an embodiment.

FIG. 12 is a side view of a triangular rotational component, according to an embodiment.

FIG. 13 is a side view of a pentagonal rotational component, according to an embodiment.

FIG. 14 is a side view of a hexagonal rotational component, according to an embodiment.

FIG. 15 is a side view of a heptagonal rotational component, according to an embodiment.

FIG. 16 is a side view of an octagonal rotational component, according to an embodiment.

DETAILED DESCRIPTION

Figures 1A, 1B:
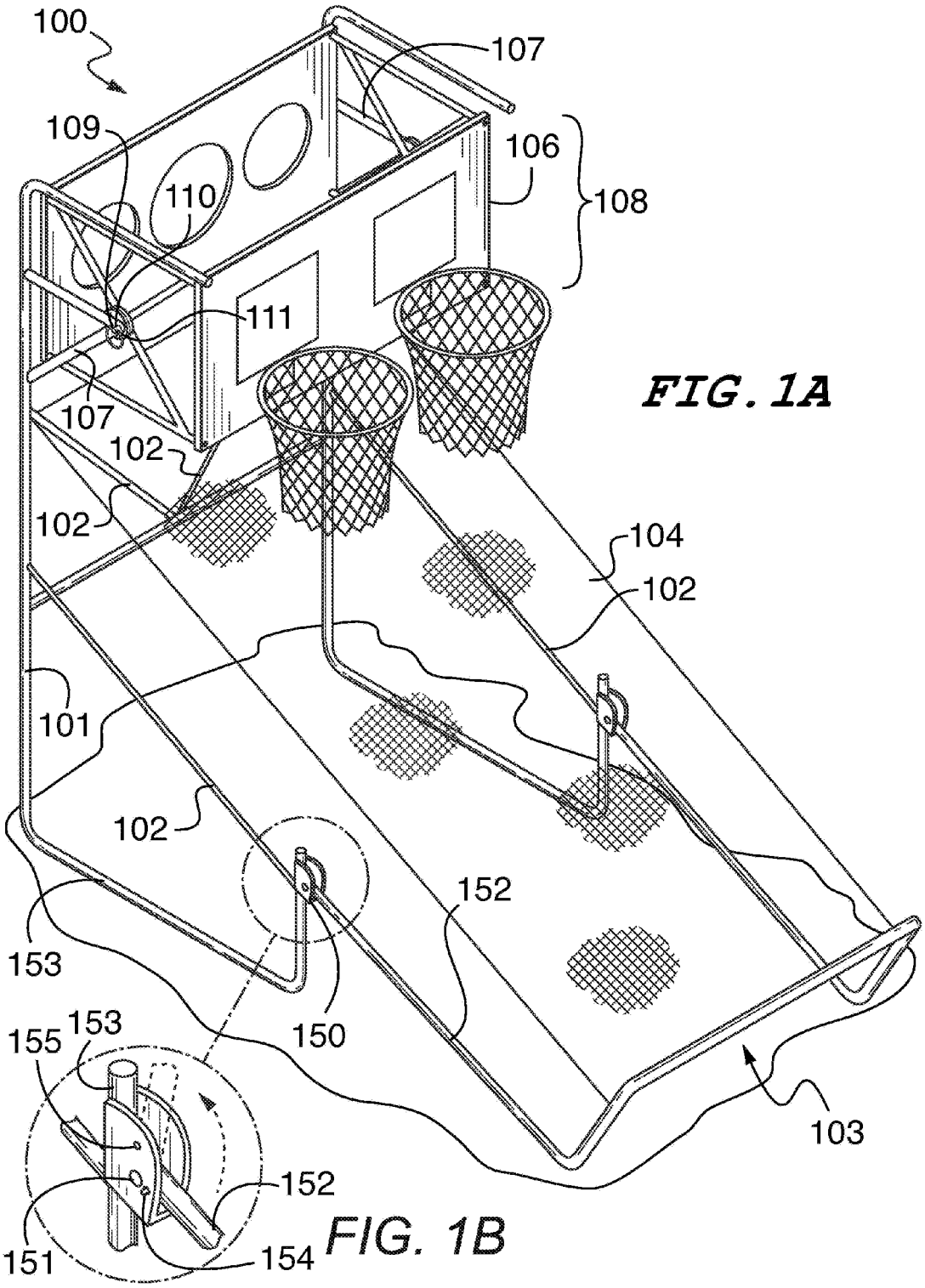
FIG. 1A is a perspective view of a convertible game system, according to an embodiment
FIG. 1B is a drawing of an enlarged portion of the game system, according to an embodiment.

This description of the exemplary embodiments is intended to be read in connection with the accompanying drawings, which are to be considered part of the entire written description. In the description, relative terms such as "lower," "upper," "horizontal," "vertical,", "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description and do not require that the apparatus be constructed or operated in a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise.

The present device can be a convertible game system that allows an athlete to select from a multitude of games, while keeping a small space footprint. The system can include a frame made from hollow or solid piping, which can be assembled before use or be bought pre-assembled. The frame can be varying in height, but should approximate a sufficient vertical length to simulate a basketball hoop system. The frame can be supported by one or more trusses that allow the frame to withstand the stress of a ball bouncing against one of the playing surfaces without tipping over and injuring spectators.

The frame can mount a rotational component, having two or more faces, which can be the main attachment point for the game surfaces. The game surfaces can include a basketball surface having one or more netted baskets, a football surface with one or more holes of sufficient diameter to admit a football, a baseball surface with one or more holes of sufficient diameter to admit a baseball, or a softball surface with one or more holes of sufficient diameter to admit a softball. Embodiments of the rotational component include a triangular, rectangular, pentagonal, hexagonal, heptagonal, and octagonal rotational component. Game surfaces can alternate with open surfaces to allow space for a ball to pass through and return to the player.

The rotational component can be mounted to support arms that are mounted to the frame, or can be mounted to the frame directly. The rotational component can be mounted with a locking bearing system. The locking bearing system allows the rotational component to rotate through a full 360 degrees of motion. A pin lock can be inserted into pre-drilled holes located on the locking bearing system, which removes the rotational system's ability to rotate, and allows the player to begin using the convertible game system. To switch game faces, the user can remove the pin lock, rotate the rotational component to display the desired face, then reinsert the lock pin to again arrest the movement of the rotational component.

The frame can have a ball return attached between selected points of the frame, such that a ball thrown or shot towards a game surface can travel back along the ball return surface towards a hopper portion of the frame, where the ball can rest before being reused. The ball return can be made as a solid sheet of material, or can be a net. The ball hopper can be a dedicated portion of the frame that, when connected with the ball return material, can arrest the ball's motion such that it can be reused by the player.

Reference will now be made in detail to the present embodiments of the invention, examples of which are illustrated in the accompanying drawings.

FIG. 1A is a perspective view of a convertible game system 100, according to an embodiment. The system can include a frame 101, which can be made from hollowed or solid tubes. The frame can be created using separate segments of pipe, such that a player could assemble the system 101 after purchase. The frame 101 can be supported by several trusses 102 which can provide support to the frame 101 to prevent bending during use. The frame 101 can have a hopper section 103 that can be designed to be a continuous bar to a ball (not shown) returning from use, when combined with a ball return 104. FIG. 1B is a drawing of an enlarged portion of the game system, according to an embodiment.

The ball return 104 can attach to select portions of the frame 101 to form an incline, such that a ball (not shown), dropping from the rotational component 106, would roll backward until arrested by the hopper section 103 of the frame 101. The ball return 104 can be made from a net material, a plastic material, canvas, a lightweight fabric, or other material. The ball return 104 material can be transparent or opaque. The ball return 104 can attached to the frame 101 using snaps, ties, staples, or other attachment mechanism.

The rotational component 106 can be mounted to support arms 107 that are mounted to the frame 101 at a mounting section 108. The rotational component 106 can be mounted with a locking bearing system 109. The locking bearing system 109 allows the rotational component 106 to rotate through a full 360 degrees of motion about the pin's 110 axis. A pin 110 can be inserted into pre-drilled holes 111 located on the locking bearing system 109, which prevents the rotational system's 106 ability to rotate, and allows the player to begin using the convertible game system 100. To switch between game faces, the user can remove the pin 110, rotate the rotational component 106 to display the desired face, then reinsert the pin 110 to again arrest the movement of the rotational component 106.

In an embodiment, a folding joint 150 can have a pivot point 151 wherein the folding section 152 can hinge against the non-folding section 153. A push-lock system can have a nubbed tab 154 with a spring back (not shown), which can pop into one of two notches or holes 155, depending on whether or not the game system is folded or unfolded.

Figure 1C:
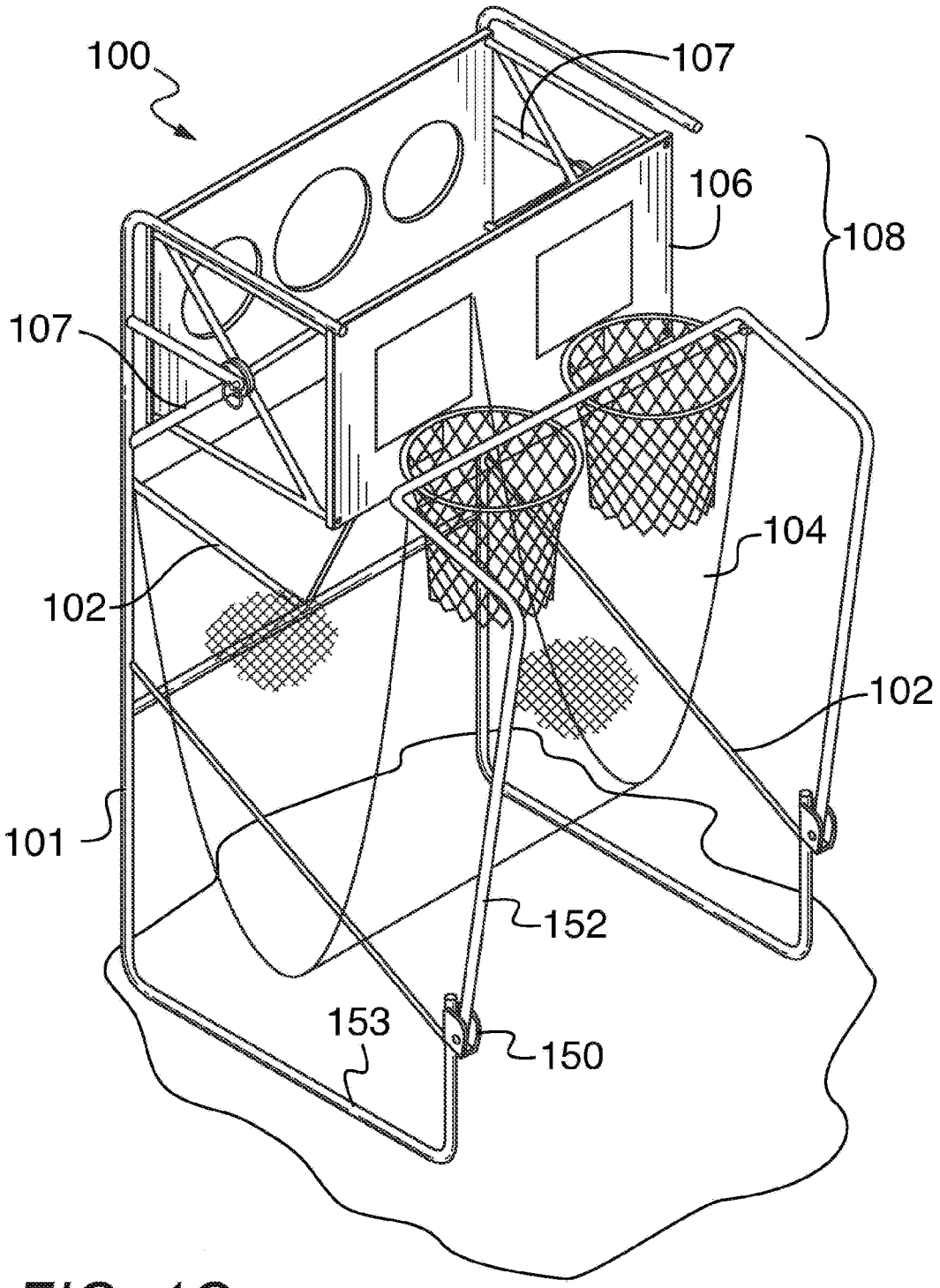
FIG. 1C is a perspective view of a folded convertible game system, according to an embodiment.

FIG. 1C is a perspective view of a folded convertible game system, according to an embodiment. The game system 100 can be folded in half for ease of transport and to save space when the game system is stored 100. The folding can be accomplished by a folding joint 150 placed onto a lower portion of the frame 101, such that the game system 100 effectively folds in half when the folding joint is utilized.

Figure 1D:
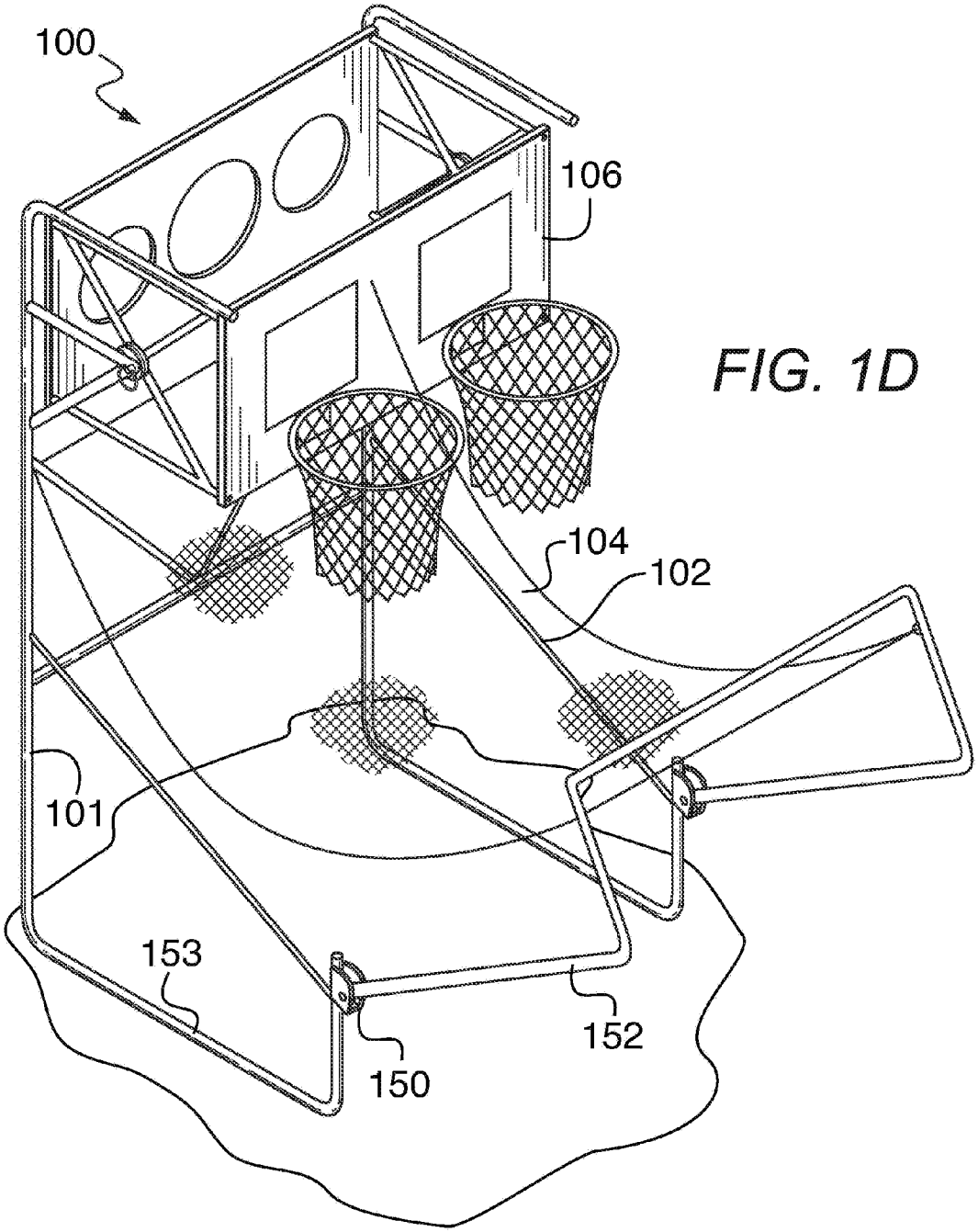
FIG. 1D is a perspective view of a convertible game system in the process of folding, according to an embodiment.

FIG. 1D is a perspective view of a convertible game system in the process of folding, according to an embodiment. The frame 101 can comprise two sections: a folding section 152 and a non-folding section 153. To fold, the user can disengage the push-lock (not shown) on the folding joint 150 to enable motion, and raise the folding section 152 towards the non-folding section 153. When the folding section 152 is in its folded position, the push-lock (not shown) can engage, locking the folded section 152 into position. To unfold, the user can disengage the push-lock (not shown) on the folding joint 152 to enable motion, and lower the folding section 152 away from the non-folding section 153. When the folding section 152 is in its unfolded position, the push-lock (not shown) can engage, locking the folded section 152 into position.

Figure 2:
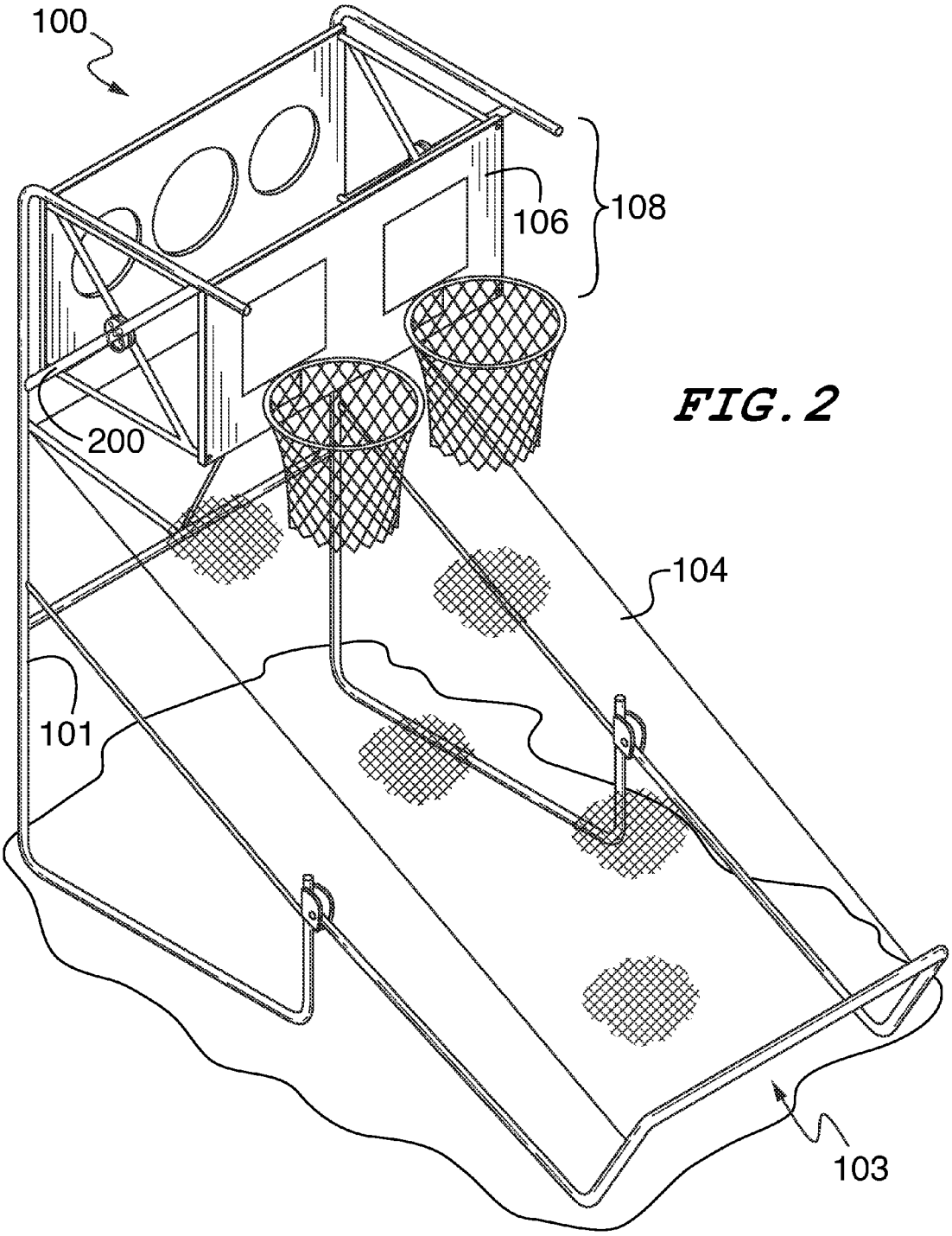
FIG. 2 is a perspective view of a convertible game system, according to an alternate embodiment.

FIG. 2 is a perspective view of a convertible game system 100, according to an alternate embodiment. In the alternate embodiment, the frame 101, rotational component 106, hopper section 103, and ball return 104 can be the same as the previous embodiment. However, the rotational component 106 can be mounted to a diagonal mounting bar 200 along the frame 101 at the mounting section 108, and does not require support arms (not shown). This can change the center of gravity of the convertible game system 100.

Figure 3:
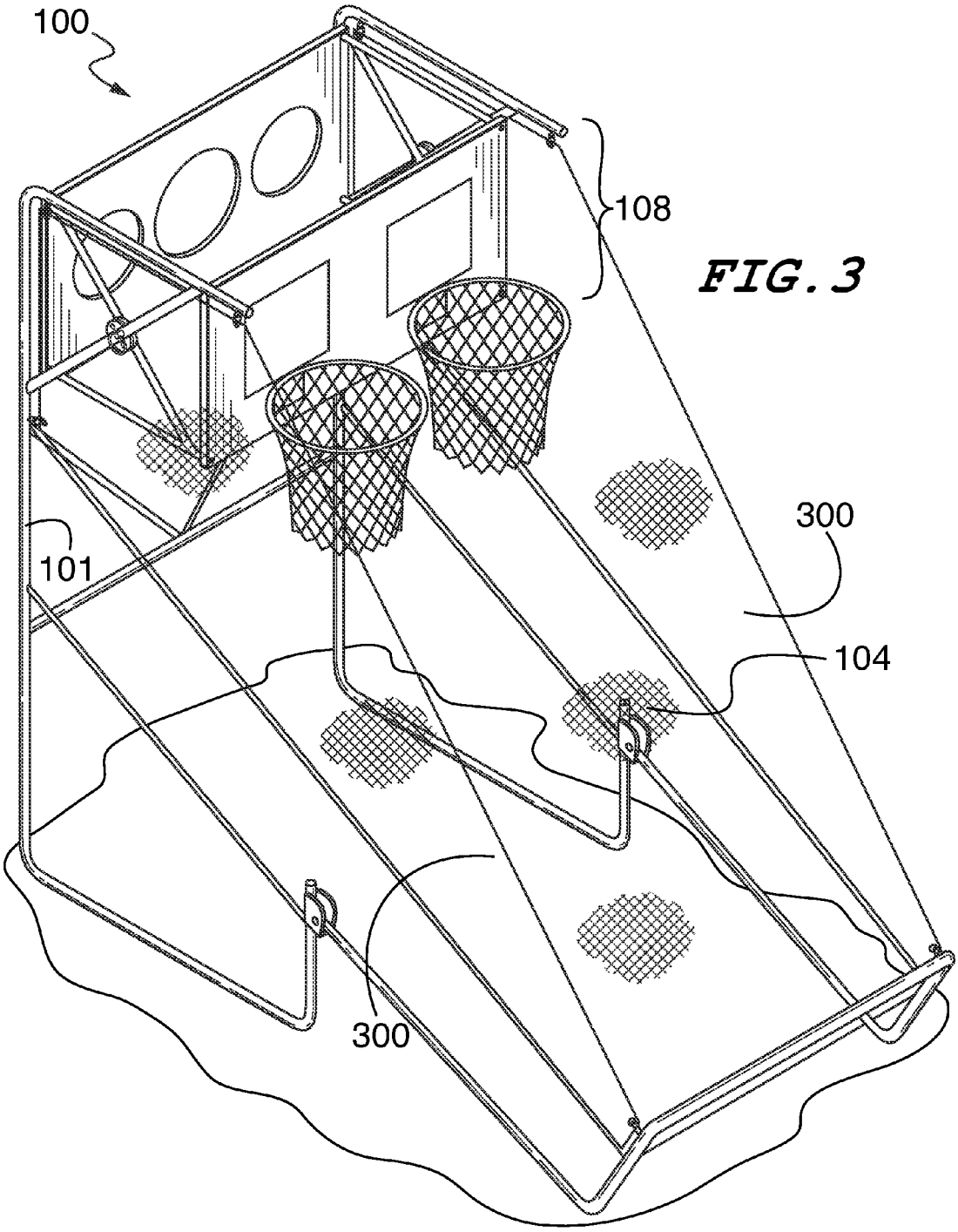
FIG. 3 is a perspective view of a convertible game system, according to an embodiment.

FIG. 3 is a perspective view of a convertible game system 100, according to an embodiment. The convertible game system 100 can have first and second side materials 300 that can be used to limit the side to side motion of a ball (not shown) if the ball (not shown) is shot inaccurately. The side materials 300 can be a solid sheet of lightweight material, netting, canvas, or other suitable material. The side material 300 can be attached to the frame 101 using snaps, ties, staples, or other attachment mechanism. The side material 300 can also be attached to the ball return 104 such that there can be no gap for a ball (not shown) to slip through.

FIG. 4 is a front view of a basketball face, according to an embodiment. The basketball face 403 can be a backboard 410 upon which one or more basketball hoops 411 can mounted. The backboard 410 can be constructed from wood, particle board, plastic, fiberglass, or other similar materials. The basketball hoops 411 can be constructed from metal, plastic, or other similar materials. The backboard 410 can be detailed with basketball markings The basketball face 403 can be attached to the frame faces 401 using screws, ties, staples, glue, or other attachment mechanisms.

FIG. 5 is a back view of a football face, according to an embodiment. The football face 402 can be a football board 420 with one or more football holes 421 that can have at least sufficient diameter to admit a regulation football (not shown). The football holes 421 can have a larger diameter to accommodate a less-skilled player (not shown). The football board 420 can be detailed with football-related markings (not shown). The football face 420 can be attached to the frame faces 401 using screws, ties, stapes, glue, or other attachment mechanisms.

Each football hole 421 can be ringed with a ball detector apparatus 450 that can detect the passage of a football (not shown) through the football hole 421. The ball detector apparatus can be similar to that described in U.S. Pat. No. 8,535,183, herein incorporated by reference in its entirety. The ball detector apparatus 450 can be electronic, and each can be connected to a central ball detector computer 451 by a wire 452. The central ball detector computer can have an alarm (not shown) that can be activated whenever a ball detector apparatus 450 detects a football (not shown) passing through a football hole 421.

FIG. 6 is a front view of a softball face, according to an embodiment. The softball face 810 can be a softball board 811 with one or more softball holes 812 that can have at least sufficient diameter to admit a regulation softball (not shown). The softball holes 812 can have a larger diameter to accommodate a less-skilled player (not shown). The softball board 811 can be detailed with softball-related markings 813. The softball face 810 can be attached to the frame faces 801 using screws, ties, stapes, glue, or other attachment mechanisms.

FIG. 7 is a front view of a baseball face, according to an embodiment. The baseball face 1010 can be a baseball board 1011 with one or more baseball holes 1012 that can have at least sufficient diameter to admit a regulation baseball (not shown). The baseball holes 1012 can have a larger diameter to accommodate a less-skilled player (not shown). The baseball board 1011 can be detailed with baseball-related markings 1013. The baseball face 1010 can be attached to the frame faces 1001 using screws, ties, stapes, glue, or other attachment mechanisms. The baseball face can also be used with beanbags or other similar throwable objects.

Figure 8A:
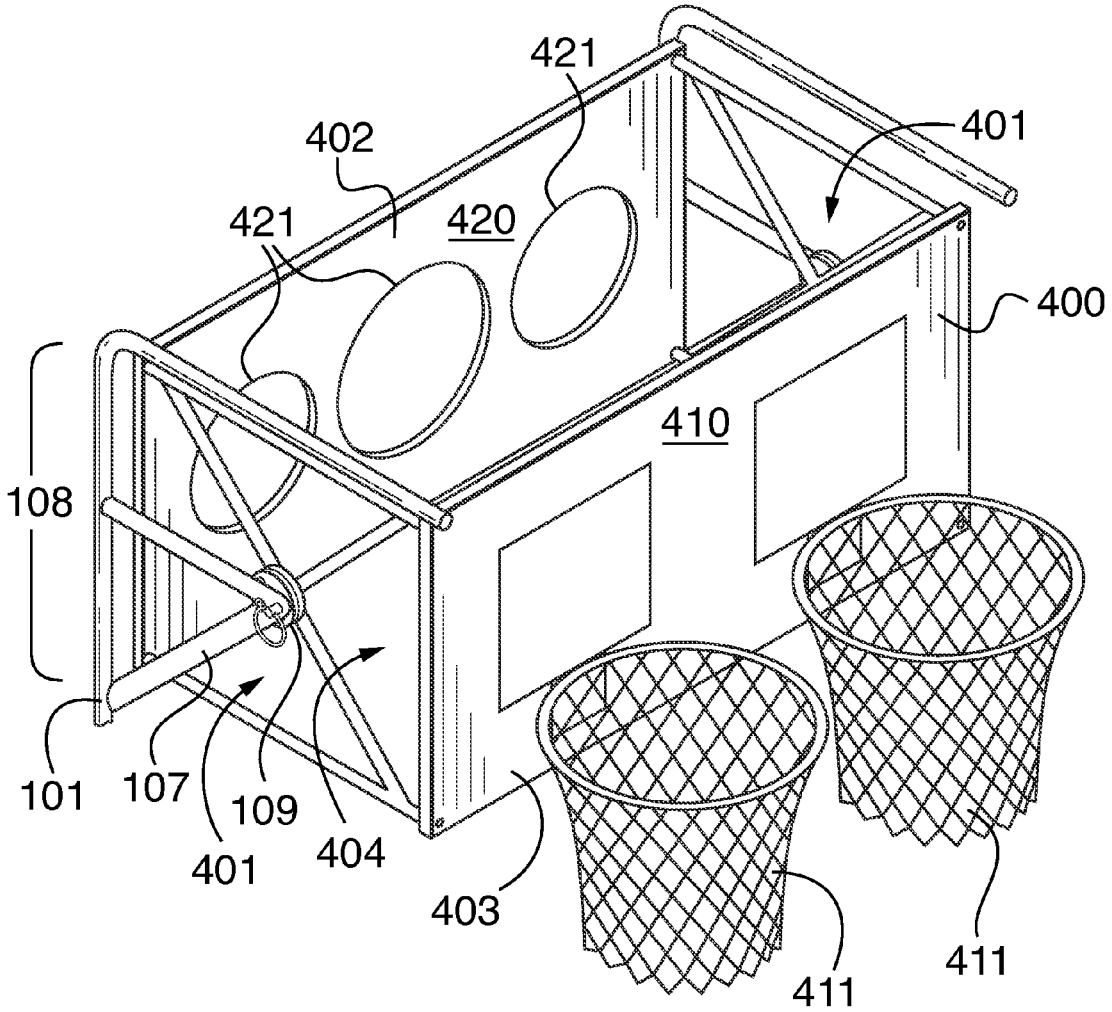
FIG. 8A is a perspective view of a rectangular rotational component, according to an embodiment.

FIG. 8A is a perspective view of a rectangular rotational component 400, according to an embodiment. The rectangular rotational component 400 can be a rectangular prism having two frame faces 401, a football face 402, a basketball face 403, and two open faces 404. The frame faces can each display four structural supports that can extend radially towards the center of the frame face 401, where the center point can be the locking bearing system 109, which can mount onto support arms 107 that can be attached to the frame 101 at the mounting section 108. The open faces 404 can be of sufficient dimensions to allow a regulation basketball (not shown) to pass through the open faces 404 and enter the ball return (not shown). All faces can be combined with one or more other faces in any variation or combination.

Figure 8B:
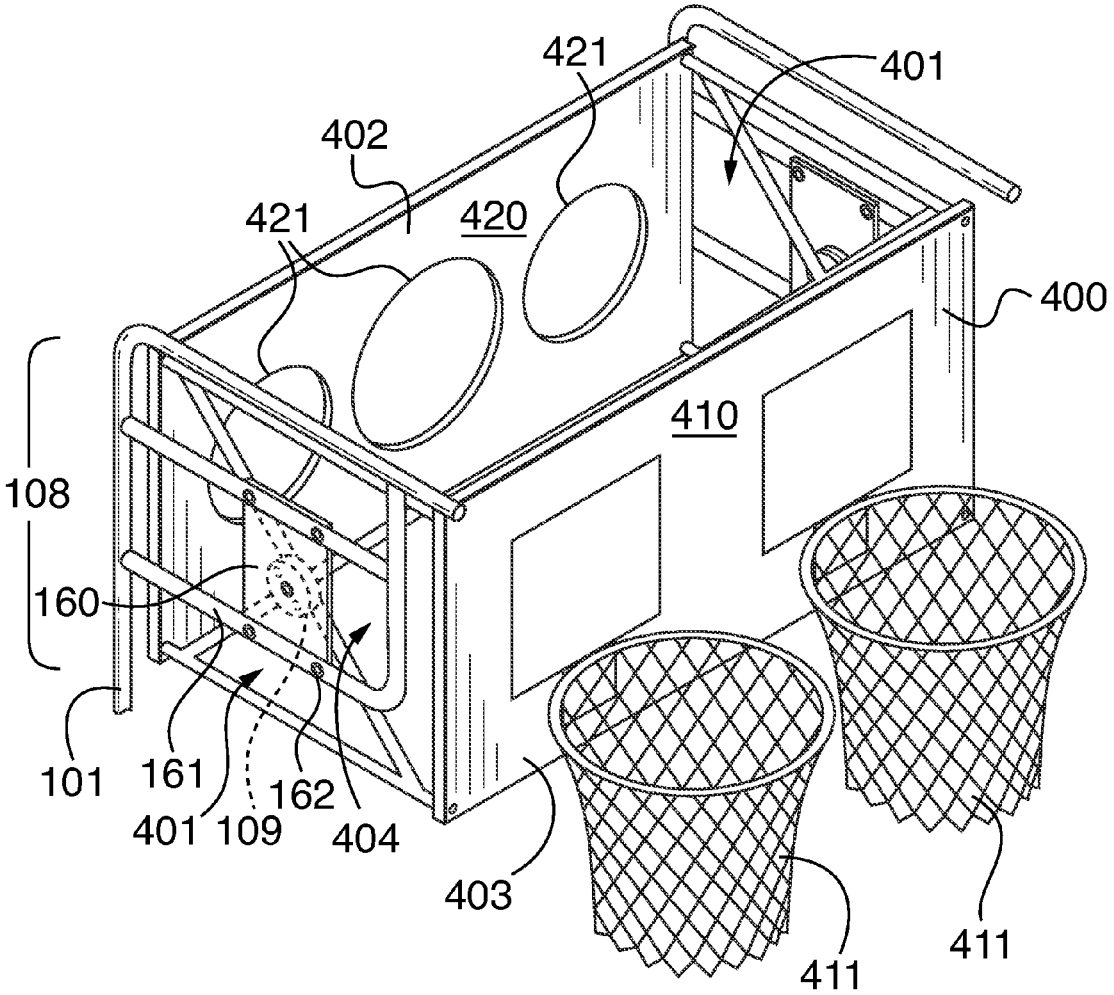
FIG. 8B is a perspective view of a rectangular rotational component, according to an alternate embodiment.

FIG. 8B is a perspective view of a rectangular rotational component 400, according to an alternate embodiment. The alternate embodiment can provide additional stability by altering the center of gravity of the entire system by altering the mounting geometry of the rectangular rotational component 400 on the frame 101, and by more securely mounting the locking mechanism 109 to both the frame 101 and the rectangular rotational component 400. In the alternate embodiment, the locking bearing system 109 on the frame faces 401 can be mounted onto a square plate 160, the square plate 160 being bolted to a rectangular support structure 161 attaching directly to the frame 101. Four bolts 162 can secure the square plate 160 with the locking mechanism 109 to the rectangular support structure 161.

FIG. 9 is a perspective view of a rectangular rotational component 400, according to an alternate embodiment. The alternate embodiment can provide additional stability by altering the center of gravity of the entire system by altering the mounting geometry of the rectangular rotational component 400 on the frame 101. In the alternate embodiment, the locking bearing system 109 on the frame faces 401 can be mounted to a diagonal mounting bar 200 located on the frame 101 at the mounting section 108, and does not require support arms (not shown).

FIG. 10 is a close up view of a locking bearing system 109, according to an embodiment. The locking bearing system 109 can have a rotational disk 600, a frame disk 601, and a pin 110. For a rectangular rotational component (not shown), both the rotational disk 600 and the frame disk 601 can each have four holes 602. For the triangular, pentagonal, hexagonal, heptagonal, and octagonal rotational components (not shown), the rotational disk 600 and frame disk 601 can each have three, five, six, seven, and eight holes, respectively (not shown). In all embodiments, the holes 602 can be of sufficient diameter to admit the pin 110.

During use, the pin 110 can be inserted through a hole 602 through the frame 101, as well as through the frame disk 601 and the rotational disk 600, arresting any movement of the rotational component 106. When a player (not shown) wishes to rotate the rotational component 106, the user (not shown) can pull the pin 110 away from the frame 101, which can remove the pin 110 from the rotational disk 600 and the frame disk 601, allowing the rotational component 106 to rotate. Once the player (not shown) has positioned the rotational component 106 in a desired position and aligned the rotational disk holes and frame disk holes 602, the user (not shown) can reinsert the pin 110 back through the frame hole 603, passing through the hole 602 in the frame disk 601 and rotational disk 600, once again preventing any motion of the rotational component 106. The pin 110 can be made from plastic or metal.

Figure 11:
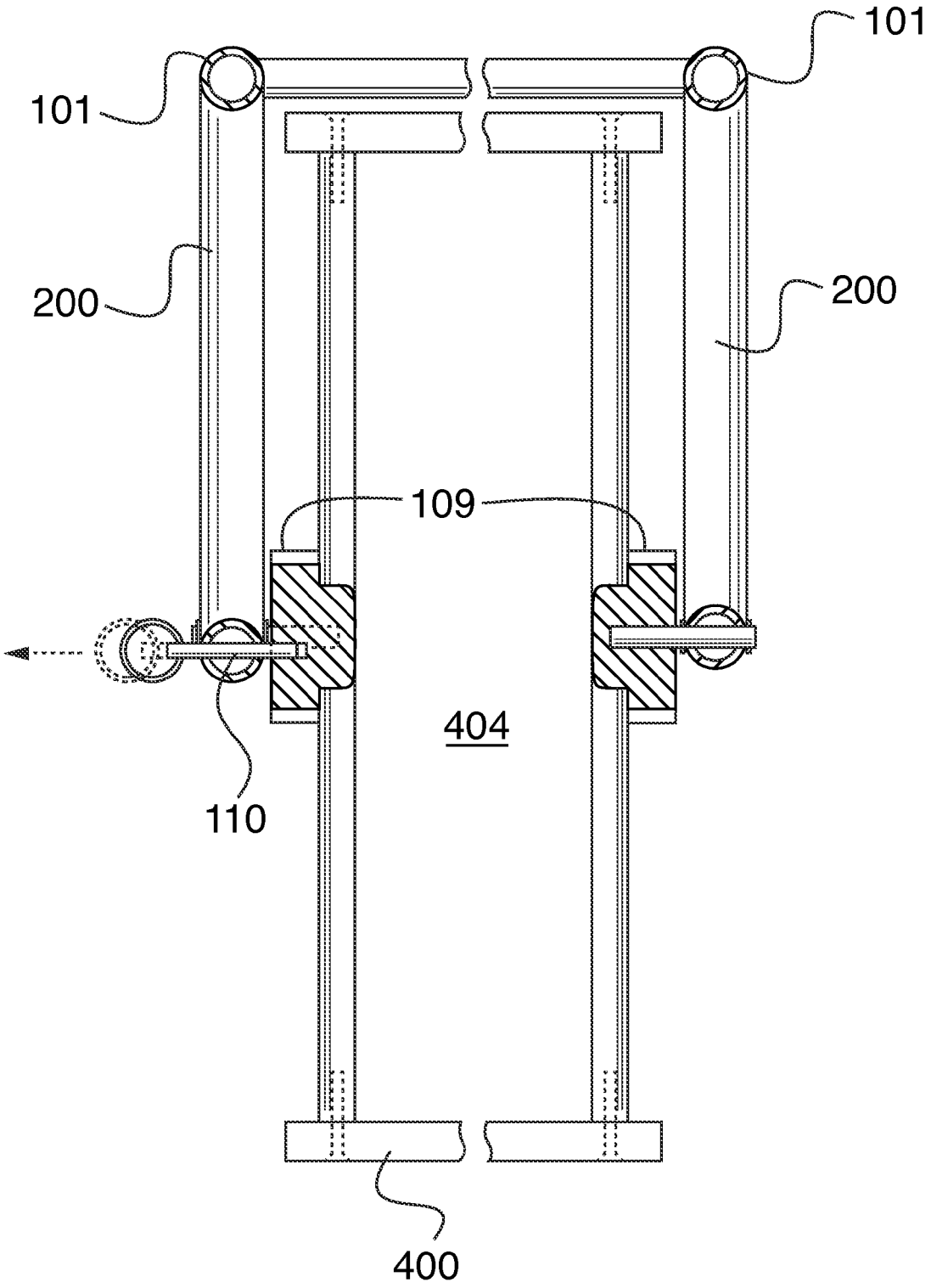
FIG. 11 is a top-down cut away view of a locking bearing system, according to an embodiment.

FIG. 11 is a top-down cut away view of a locking bearing system 109, according to an embodiment. The pin 110 can be inserted entirely through the frame 101 at the support arm 200, before entering the locking bearing mechanism 109. There can be sufficient space between the frame 101 and the game faces 400 of the system 100 such that the rotational component can freely and fully rotate. The locking bearing systems 109 are symmetrical and identical.

FIG. 12 is a side view of a triangular rotational component 700, according to an embodiment. The triangular rotational component 700 can be a triangular prism having two frame faces 701, a football face 402, a basketball face 403, and an open face 404. The frame faces 701 can display three structural supports 705 that can extend radially towards the center of the frame face 701, where the center point can be the locking bearing system 109. The open face 404 can be of sufficient dimensions to allow a regulation basketball (not shown) to pass through and enter the ball return (not shown).

FIG. 13 is a side view of a pentagonal rotational component 800, according to an embodiment. The pentagonal rotational component 800 can be a pentagonal prism having two frame faces 801, a football face 402, a basketball face 403, a softball face 810, and two open faces 404. The frame faces 801 can display five structural supports 805 that can extend radially towards the center of the frame face 801, where the center point can be the locking bearing system 109. The open faces 404 can be of sufficient dimensions to allow a regulation basketball (not shown) to pass through and enter the ball return (not shown).

FIG. 14 is a side view of a hexagonal rotational component 900, according to an embodiment. The hexagonal rotational component 900 can be a hexagonal prism having two frame faces 901, a football face 402, a basketball face 403, a softball face 810, and three open faces 404. The frame faces 901 can display six structural supports 905 that can extend radially towards the center of the frame face 901, where the center point can be the locking bearing system 109. The open faces 404 can be of sufficient dimensions to allow a regulation basketball (not shown) to pass through them and enter the ball return (not shown).

FIG. 15 is a side view of a heptagonal rotational component 1000, according to an embodiment. The heptagonal rotational component 1000 can be a heptagonal prism having two frame faces 1001, a football face 402, a basketball face 403, a softball face 810, a baseball face 1010, and three open faces 404. The frame faces 1001 can display seven structural supports 1005 that can extend radially towards the center of the frame face 1001, where the center point can be the locking bearing system 109. The open faces 404 can be of sufficient dimensions to allow a regulation basketball (not shown) to pass through and enter the ball return 104.

FIG. 16 is a side view of an octagonal rotational component 1100, according to an embodiment. The octagonal rotational component 1100 can be an octagonal prism having two frame faces 1101, a football face 402, a basketball face 403, a softball face 810, a baseball face 1010, and four open faces 404. The frame faces 1101 can display eight structural supports 1105 that can extend radially towards the center of the frame face 1101, where the center point can be the locking bearing system 109. The open faces 404 can be of sufficient dimensions to allow a regulation basketball (not shown) to pass through and enter the ball return 104.

The many features and advantages of the inventive concept are apparent from the detailed specification and, thus, it is intended by the appended claims to cover all such features and advantages of the concept that fall within its true spirit and scope. Further, since numerous modifications and changes will readily occur to those skilled in the art, it is not desired to limit the inventive concept to the exact construction and operation illustrated and described, and accordingly all suitable modifications and equivalents may be resorted to, falling within the scope of the inventive concept.

What is claimed is:

1. A convertible game system, comprising:

a frame, having a mounting section, a hopper section, and at least one truss;

a rotational component, having at least two frame faces, at least one open face, and at least one game face, each frame face comprising at least one structural support and a locking bearing system attached to the at least one structural support;

a ball return, wherein the ball return is attached to the frame at an incline between the mounting section and the hopper section, wherein the rotational component is attached to the mounting section through the locking bearing system.

2. The convertible game system as recited in claim 1, the mounting section further comprising: at least one support arm, wherein the rotational component is attached to the at least one support arm.

3. The convertible game system as recited in claim 1, the mounting section further comprising: at least one diagonal mounting bar, wherein the rotational component is attached to the diagonal mounting bar.

4. The convertible game system as recited in claim 1, the mounting section further comprising: at least one rectangular support structure, having a square plate, wherein the rotational component is attached to the square plate attached to the rectangular support structure.

5. The convertible game system as recited in claim 1, further comprising: a first side material and; a second side material; wherein the first side material and the second side material attach to the frame at the mounting section and the hopper section, and the ball return.

6. The convertible game system as recited in claim 1, the at least one game face further comprising: a basketball face, comprising a backboard, and at least one basketball hoop; wherein the at least one basketball hoop is attached to the backboard.

7. The convertible game system as recited in claim 1, the at least one game face further comprising: a football face, comprising a football board having at least one football hole; wherein the at least one football hole is of a minimum diameter to admit a football.

8. The convertible game system as recited in claim 1, the at least one game face further comprising: at least one ball detector apparatus, being connected to a central ball detector computer, wherein the at least one ball detector apparatus is configured to detect a ball passing through the ball detector apparatus.

9. The convertible game system as recited in claim 1, the at least one game face further comprising: a softball face, comprising a softball board having at least one softball hole; wherein the at least one softball hole is of a minimum diameter to admit a softball.

10. The convertible game system as recited in claim 1, the at least one game face further comprising: a baseball face, comprising a baseball board having at least one baseball hole; wherein the at least one baseball hole is of a minimum diameter to admit a baseball.

11. The convertible game system as recited in claim 1, the frame further comprising:

at least two segments of pipe;

wherein the at least two segments of pipe are configured to assemble into the frame.

12. The convertible game system as recited in claim 1, wherein: the game system further comprises at least one pin; the frame further comprises at least one frame hole; the locking bearing system further comprises a rotational disk having at least one rotational disk hole and a frame disk having at least one frame disk hole, wherein the at least one frame hole, the at least one frame disk hole, and the at least one rotational disk hole are of a diameter to admit the at least one pin.

13. The convertible game system as recited in claim 1, further comprising: an attachable component, wherein the attachable component is configured to attach to the hopper section of the frame.

14. The convertible game system as recited in claim 1, further comprising:

at least one folding joint having at least one push-lock configured to be inserted into at least one notch;

the frame further comprises a non-folding section and a folding section, wherein the non-folding section and the folding section hinge at the at least one folding joint.

15. A method of using a convertible game system, comprising:

providing a convertible game system comprising a frame having a mounting section, a hopper section, and at least one truss; a rotational component, having two frame faces, at least one open face, and at least one game face, each frame face comprising at least one structural support and a locking bearing system attached to the at least one structural support; a pin; a ball return, wherein the ball return is attached to the frame at an incline between the mounting section and the hopper section, wherein the rotational component is attached to the mounting section through the locking bearing system;

removing the pin from the convertible game system;

rotating the rotational component until the at least one game face is correctly displayed; and inserting the pin into the convertible game system.

16. The method as recited in claim 15, wherein the providing further provides that the at least one game face comprises a basketball face, comprising a backboard, and at least one basketball hoop, wherein the at least one basketball hoop is attached to the backboard.

17. The method as recited in claim 15, wherein the providing further provides that the at least one game face comprises a football face, comprising a football board having at least one football hole, wherein the at least one football hole is of a minimum diameter to admit a football.

18. The method as recited in claim 15, wherein the providing further provides that the at least one game face comprises at least one ball detector apparatus connected to a central ball detector computer, wherein the at least one ball detector apparatus is configured to detect a ball passing through the ball detector apparatus.

19. The method as recited in claim 15 wherein the providing further provides that the at least one game face comprises a baseball face, comprising a baseball board having at least one baseball hole, wherein the at least one baseball hole is of a minimum diameter to admit a baseball.

20. The method as recited in claim 15, wherein the providing further provides that the at least one game face comprises a softball face, comprising a softball board having at least one softball hole, wherein the at least one softball hole is of a minimum diameter to admit a softball.

* * * * *